US005452806A

United States Patent [19]

Campas

[11] Patent Number: 5,452,806

[45] Date of Patent: Sep. 26, 1995

[54] ORGANIZER FOR HAIR BOWS, JEWELRY, AND SIMILAR ITEMS

[76] Inventor: Shelia L. Campas, P.O. Box 106, Leoti, Kans. 67861

[21] Appl. No.: 210,930

[22] Filed: Mar. 21, 1994

[51] Int. Cl.[6] ..... A47F 5/00; A47F 7/00

[52] U.S. Cl. ..... 211/13; 206/6.1; 206/495; 211/113

[58] Field of Search ..... 211/13, 113; 206/6.1, 206/495

[56] References Cited

U.S. PATENT DOCUMENTS

| | | | |
|---|---|---|---|
| 4,749,088 | 6/1988 | Workman et al. | 211/113 X |
| 4,821,883 | 4/1989 | Miller | 206/495 |
| 4,966,287 | 10/1990 | Snyder | 211/13 |
| 5,031,758 | 7/1991 | Gonzalez | 206/6.1 |
| 5,031,777 | 7/1991 | Knox | 211/13 |
| 5,117,988 | 6/1992 | Daniels | 248/205.2 X |
| 5,172,814 | 12/1992 | Pell et al. | 211/13 |
| 5,259,497 | 11/1993 | Brothers et al. | 211/13 X |
| 5,295,587 | 3/1994 | Downes et al. | 206/495 X |

*Primary Examiner*—Robert W. Gibson, Jr.
*Attorney, Agent, or Firm*—David L. Baker; Robert A. Shack; Rhodes and Ascolillo

[57] ABSTRACT

A storage-type organizer for hair bows, jewelry, and similar items. The organizer includes a thin, vertical, elongate body member and a fabric covering the elongate body member. The body member has a thickness such that pierced earrings can be inserted therethrough, and has a thickness and a width such that hair bows and barrettes can be clamped therearound. It also has a composition such that pins can be inserted and held therein.

4 Claims, 2 Drawing Sheets

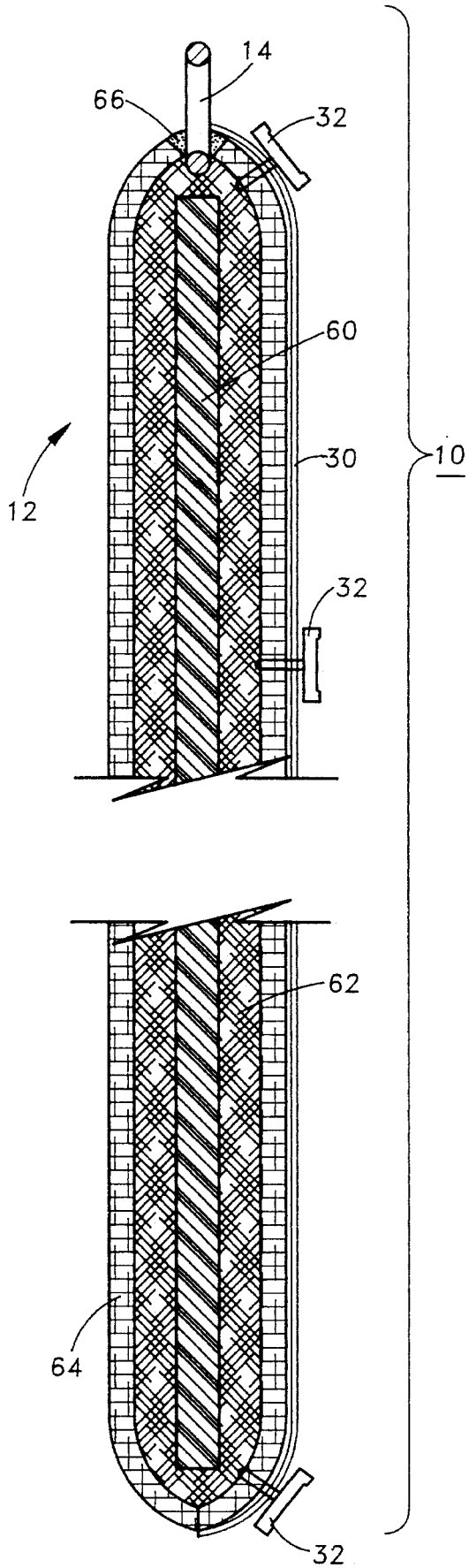
FIG. 2
FIG. 3
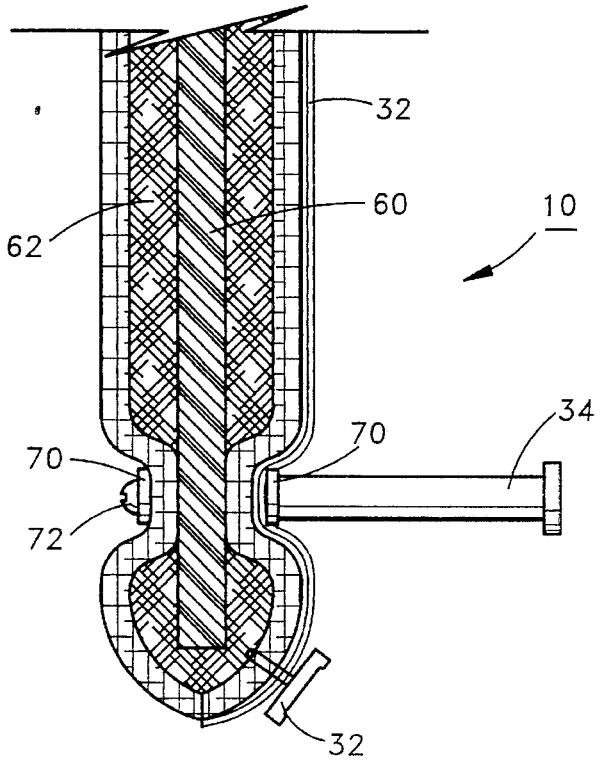

ORGANIZER FOR HAIR BOWS, JEWELRY, AND SIMILAR ITEMS

BACKGROUND OF THE INVENTION

1. Field of the Invention

The present invention generally relates to organizers for personal items and, more particularly, but not by way of limitation, to a novel storage-type organizer for hair bows, jewelry, and similar items.

2. Description of the Related Art

Hair bows, jewelry, and similar items are frequently kept in drawers where they can become wrinkled, lost, and sometimes even dirty from being mixed together in the drawers. This problem is aggravated when traveling, because there is no satisfactory way to pack a large number of such items and they become even more susceptible to damaged or loss.

Some attempts to provide organizers are described in the following patents:

U.S. Pat. No. 4,966,287, issued Oct. 30, 1990, to Snyder, describes a portable jewelry holder and organizer for jewelry and accessories that includes a hook at the top of a generally planar plastic frame. The frame includes a plurality of holes, slots, bars, and rings for the attachment thereto of various pins, bows, necklaces, rings, bracelets, and small items of clothing. The holder is intended to be carried between locations much as is a item of clothing on a coat hanger. The device is rather bulky and, despite being intended to be portable, would be somewhat difficult to transport.

U.S. Pat. No. 5,031,758, issued Jul. 16, 1991, to Gonzalez, describes an organizer or display for jewelry and accessories which includes a braid of three bundles of yarn to which may be attached various jewelry and accessory items by clamping such items to the braid or inserting portions of the items through the braid. The braid lacks sturdiness and is subject to having the strands of yarn "picked" or otherwise damaged by the jewelry items and is also subject to becoming unbraided.

U.S. Pat. No. 5,031,777, issued Jul. 16, 1991, to Knox, describers a magnetic holder for bows and similar accessories that have ferromagnetic parts. The holder includes a plurality of thin vertical members having magnets disposed on the rear surfaces thereof. The bows or other accessories having ferromagnetic parts are placed against the front surfaces of the metal strips and are held thereagainst by the magnetic fields of the magnets. The device lacks compactness and is of limited versatility, since it can be employed only with items having ferromagnetic components.

U.S. Pat. No. 5,172,814, issued Dec. 22, 1992, to Pell al., describes a board for holding, displaying, and organizing articles of jewelry. The board includes a plurality of repositionable fixtures attached to the front surface thereof, the fixtures being variously designed for the attachment thereto of pierced earrings, clip earrings, rings, bracelets, pins, broaches, and other jewelry items. The board is relatively bulky and is not particularly well suited for traveling.

Accordingly, it is a principal object of the present invention to provide a storage-type organizer for hair bows, jewelry, and similar items that is sturdy and durable.

It is a further object of the invention to provide such an organizer that is relatively compact and can be transported easily.

It is an additional object of the invention to provide such an organizer that is easily and economically constructed.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, A storage-type organizer for hair bows, jewelry, and similar items. The organizer includes a thin, vertical, elongate body member and a fabric covering the elongate body member. The body member has a thickness such that pierced earrings can be inserted therethrough, and has a thickness and a width such that hair bows and barrettes can be clamped therearound. It also has a composition such that pins can be inserted and held therein.

Preferably, the organizer further includes a hanging mechanism to suspend it from a selected structure. Additionally, the body member includes a central core of semi-flexible plastic mesh extending approximately the length of the body member, a layer of batting surrounding the central core, with the layer of fabric covering the layer of batting. A vertical ribbon is also disposed on an outer surface of the organizer and attached thereto, to which ribbon small articles of jewelry can be clamped. There is at least one dowel extending horizontally from, and orthogonal to a longitudinal axis of the organizer, on which personal accessory items can be supported. Finally, the hanging mechanism includes a ring member attached to the body member.

BRIEF DESCRIPTION OF THE DRAWINGS

Understanding of the present invention and the various aspects thereof will be facilitated by reference to the accompanying drawing figures, submitted for purposes of illustration only and not intended to define the scope of the invention, on which:

FIG. 2 is an enlarged, side elevational view, partially in cross-section, of the organizer; and FIG. 3 is an enlarged, side elevational view, partially in cross-section, of the organizer, showing a construction detail.

DESCRIPTION OF THE PREFERRED EMBODIMENT

Figure 1:
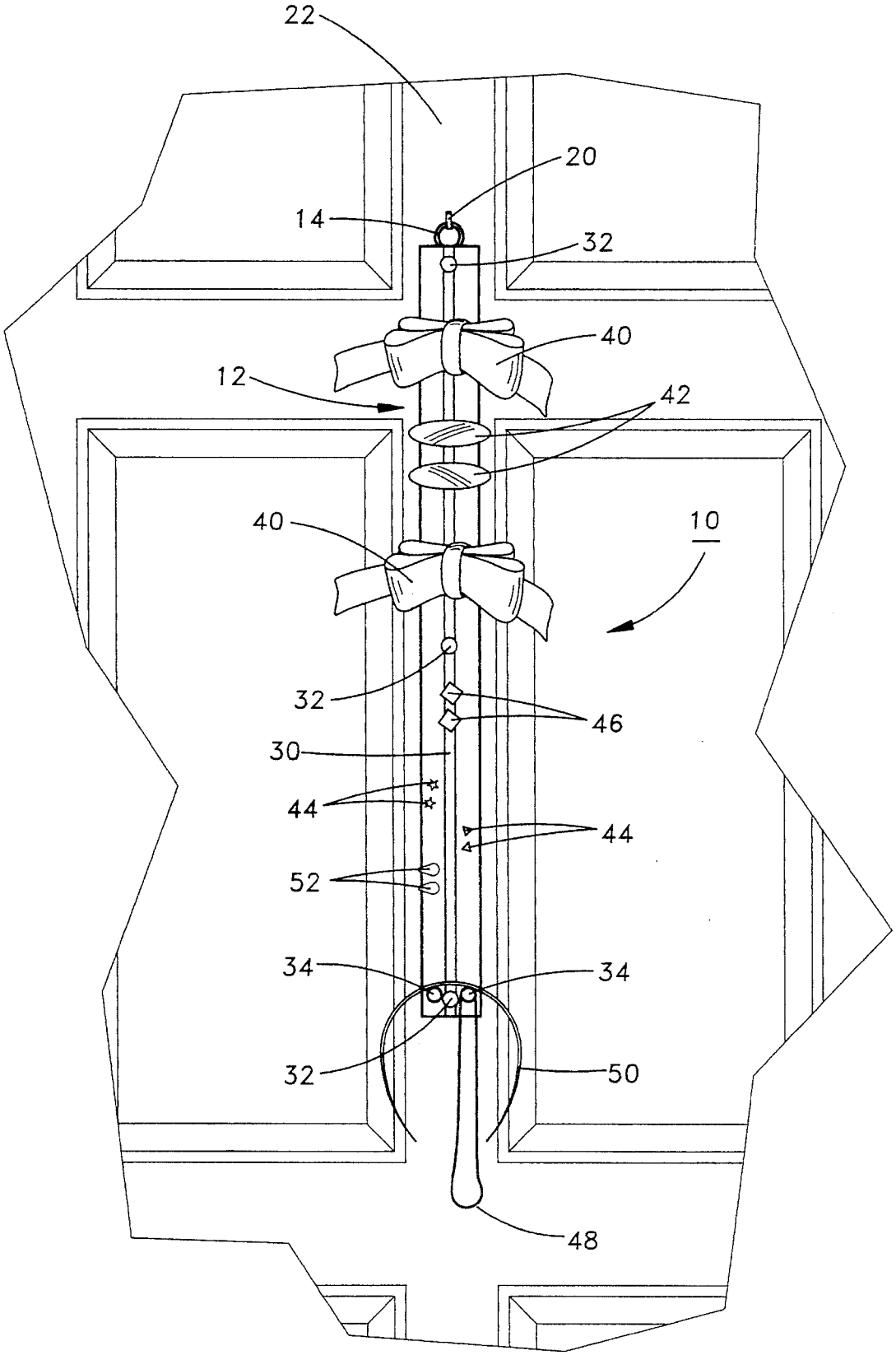
FIG. 1 is a front elevational view of an organizer according to the present.invention, in use.

Reference should now be made to the drawing figures, on which similar or identical elements are given consistent identifying numerals throughout the various figures, and on which parenthetical references to figure numbers direct the reader to the view(s) on which the element(s) being described is (are) best seen, although the element(s) may be seen also on other views.

Referring now to FIG. 1, there is illustrated an organizer according to the present invention, generally indicated by the reference numeral 10. Organizer 10 includes an elongate vertical body member 12 with a ring 14 disposed at the upper edge thereof for hanging the organizer in a convenient location. In this case organizer 10 is shown hanging from a hook 20 inserted in a door mullion 22 which may be assumed to be part of a closet door, for example. Organizer 10 further includes a relatively narrow ribbon 30 extending from top to bottom along the center of the outer surface of body member 12 and fixedly attached thereto by means of buttons 32. Two dowels 34 extend horizontally outwardly from the lower member of the outer surface of body member 12, substantially perpendicular to its longitudinal axis.

For illustrative purposes only, organizer 10 is shown as having attached thereto hair bows 40, with the clasps thereof (not shown) clamped fully around body member 12. Barrettes 42 are similarly clamped around the body member 12, with pairs of pierced earrings 44 inserted therethrough. A pair of clip earrings 52 is clipped to body member 12, and stick pins 46 are inserted through ribbon 30 and into the body member 12. Finally, a necklace 48 is looped over one of dowels 34, with a semi-rigid hair band 50 placed over both dowels. It will be understood that organizer 10 may be employed for the storage of any jewelry or accessory item, provided that the item can be hung from, clamped to, or inserted into the organizer. So attached to organizer 10, the items are well organized, easy to find, and are less subject to becoming soiled, wrinkled, or misshapen.

Referring now to FIG. 2, body member 12 includes a central core 60 of semi-flexible plastic mesh extending approximately the length of the body member 12. Surrounding core 60 is a layer 62 of polyester quilt batting into which, or through which, items to be attached to organizer 10 (FIG. 1) may be inserted. A layer 64 of fabric covers layer 62 and should be of a type which is not affected by repeated prickings by pins and pierced earrings. Ring 14 is attached to vertical body member 12 by means of glue 66, or other suitable adhesive.

FIG. 3 illustrates the means of attachment of dowels 34 to body member 12. Here, a dowel 34 has been inserted depthwise through body member 12 and secured therein by two washers 70 and a screw 72, as shown. Dowels 34 are preferably formed from round plastic stock, about ⅜-inch in diameter, and are about 2 inches long, although the dowels may be of any suitable diameter and length.

The dimensions of body member 12 will be suitably selected such that the thickness thereof will accommodate pierced earrings attached therethrough depthwise, and such that the width thereof will accommodate hair bows and larger barrettes to be clamped therearound, and such that the length thereof will permit organizer 10 to be carried in a suitcase if desired.

Organizer 10 may be easily and economically constructed using conventional adhesives and sewing techniques.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A storage-type organizer for hair bows, jewelry, and similar items, comprising:

(a) a thin, vertical, elongate body member;

(b) a layer of fabric covering said elongate body member; and (c) said body member comprising:

a thickness such that pierced earrings can be inserted therethrough;

a thickness and a width such that hair bows and barrettes can be clamped therearound;

said body member having a composition such that pins can be inserted and held therein;

a central core of semi-flexible plastic mesh extending approximately the length of said body member;

a layer of batting surrounding said central core; and said layer of fabric covering said layer of batting; and (d) a vertical ribbon disposed on an outer surface of said organizer and attached thereto, to which ribbon small articles of jewelry can be clamped.

2. A storage-type organizer, as defined in claim 1, further comprising hanging means to suspend said organizer from a selected structure.

3. A storage-type organizer, as defined in claim 1, further comprising at least one dowel extending horizontally from, and orthogonal to a longitudinal axis of said organizer, on which said at least one dowel personal accessory items can be supported.

4. A storage-type organizer, as defined in claim 2, wherein said hanging means comprises a ring member attached to said body member.

* * * * *